US005311829A

United States Patent [19]

Clark et al.

[11] Patent Number: 5,311,829

[45] Date of Patent: May 17, 1994

[54] METHOD FOR REDUCTION OF SULFUR OXIDES AND PARTICULATES IN COAL COMBUSTION EXHAUST GASES

[75] Inventors: Kimble J. Clark, Los Altos; Tsveton S. I. Torbov; Robert J. Impev, both of San Jose, all of Calif.; Thomas D. Burnett, Houston, Tex.

[73] Assignees: Aptech Engineerig Services, Inc., Sunnyvale, Calif.; Gas Research Institute, Chicago, Ill.

[21] Appl. No.: 855,253

[22] Filed: Mar. 23, 1992

Related U.S. Application Data

[63] Continuation-in-part of Ser. No. 627,642, Dec. 14, 1990, abandoned.

[51] Int. Cl.[5] ..... F23J 15/00

[52] U.S. Cl. ..... 110/345; 110/344; 110/347

[58] Field of Search ..... 110/344, 345, 212, 347; 423/242.1

[56] References Cited

U.S. PATENT DOCUMENTS

| | | | |
|---|---|---|---|
| 4,710,365 | 12/1987 | Gebhard et al. | 423/244 |
| 4,779,545 | 10/1988 | Breen et al. | 110/212 |
| 4,960,577 | 10/1990 | Torbov et al. | 423/242 |
| 5,042,404 | 9/1991 | Booth et al. | 110/347 |
| 5,078,064 | 1/1992 | Breen et al. | 110/212 |

OTHER PUBLICATIONS

R. C. Booth, B. P. Breen, C. A. Gallaer and R. W. Glickert "Natural Gas/Pulverized Coal Cofiring Performance Testing At An Electric Utility Boiler", *Gas Research Institute Topical Report (Jun.-Oct. 1986)*, Jul. 1987.

"Natural Gas Cofiring For Coal Boilers", *Gas Research Institute Technology Profile*, Sep. 1987.

Jason Makansi, "Cofiring Gas: Cure For Ailing Powerplants?", *Power*, pp. 19-20 Sep. 1989.

J. M. Pratapas, "Extended Development Of Gas Cofiring To Reduce Sulfur Dioxide And Nitric Oxide Emissions From A Tangentially Coal-Fired Utility Boiler", *Topical Report Aug. 1987-Feb. 1988*, Gas Research Institute, Aug. 1988.

*Primary Examiner*—Edward G. Favors
*Attorney, Agent, or Firm*—Limbach & Limbach

[57] ABSTRACT

A process for reducing sulfur emissions and increasing particulate removal in the combustion of pulverized coal is presented. Pulverized sulfur-containing coal is injected along with combustion air into a combustion chamber and fired to create a combustion zone within the chamber, thereby creating gaseous sulfur and particulate emission products. The emission products are directed to an exhaust means where the particulate emission products are removed. A fuel having negligible sulfur content and a heating value higher than coal is injected in substantially the same direction as the coal and combustion air stream into a region of the combustion zone through which a majority of the of the gaseous sulfur emissions must pass to reach the exhaust means, thus increasing the temperature of the region in an amount sufficient to increase the sulfur content of the particulate emission products.

5 Claims, 7 Drawing Sheets

METHOD FOR REDUCTION OF SULFUR OXIDES AND PARTICULATES IN COAL COMBUSTION EXHAUST GASES

This is a continuation-in-part of co-pending application Ser. No. 07/627,642 filed on Dec. 14, 1990, abandoned.

BACKGROUND

1. Field of the Invention

The present invention relates to emission control for combustion processes, and more particularly, to reducing the gaseous sulfur-containing compounds and particulate matter which result from firing pulverized coal in a combustion device.

2. Description of the Prior Art

The use of sulfur-bearing coals containing mineral matter in various combustion installations (steam boilers, furnaces, and the like) results in the production of sulfur-containing compounds, such as sulfur dioxide, sulfur trioxide, and fly ash particulates. These are pollutants and must be removed to a certain extent from the exhaust gases prior to release into the atmosphere. Various methods are known to attempt to deal with this problem.

The sulfur-containing compounds are usually absorbed by different sorbents injected either into the firebox or into a scrubber installed downstream of the combustion device. This causes increased mineral matter in the flue gas discharged by the system, and thus requires additional use of energy (heat and electrical power) for the particulate removal process.

The fly ash particulates are removed from the exhaust gases by various means, such as filtration of the flue gas, or use of an electrostatic precipitator. The efficiency of an electrostatic precipitator depends on many factors, including the electrical conductivity of the particulate matter. Increased conductivity results in improved precipitation performance. The electrical conductivity in turn depends in part on the sulfur concentration in the particulate matter. In general, conductivity increases with increasing sulfur concentration in the particulate matter. Because of this, in order to improve the electrostatic precipitator performance when low sulfur coal is burned, sulfur is often introduced with the coal, or sulfur trioxide is injected into the flue gas.

The problem of achieving a reduction in sulfur-containing compounds and an increase in efficiency of particulate removal, while eliminating the use of additives and additional scrubbing processes or gas particulate cleaning processes, has not been adequately resolved.

The concept of cofiring natural gas with coal to improve emission performance is not new. Compared to coal, natural gas contains negligible sulfur and no mineral matter. It is known that partial replacement of coal with natural gas will result in a reduction in sulfur compounds and particulates proportional to the reduction in sulfur and mineral matter input. It is also known that cofiring of natural gas and oil yields a plume which is almost invisible.

The most significant development work on cofiring technology was conducted as a result of the Gas Research Institute's Cheswick Station project. It was discovered that cofiring natural gas with coal could result in a percentage reduction in sulfur dioxide emissions which was greater than the percentage reduction in sulfur and mineral matter input. Further, if a small amount of gas is fired simultaneously with coal, carbon burnout is improved, resulting in improved electrostatic precipitator performance and reduced plume opacity.

SUMMARY OF THE INVENTION

A process for reducing gaseous sulfur dioxide and increasing particulate matter removal in the emission products from the combustion of pulverized coal is presented. Pulverized sulfur-containing coal is injected along with combustion air into a combustion chamber and fired to create a combustion zone within the chamber, thereby creating emission products, including gaseous sulfur compounds and particulate matter. The emission products are directed to an exhaust means where the particulate matter is removed. By injecting a fuel containing negligible sulfur and having a heating value higher than coal into a region of the combustion zone through which a majority of the of the gaseous sulfur compounds must pass to reach the exhaust means, and by injecting the fuel substantially in parallel to the coal and combustion air, the temperature of the region is increased in an amount sufficient to increase the sulfur content of the particulate matter, thereby reducing the amount of gaseous sulfur dioxide.

DETAILED DESCRIPTION OF THE INVENTION

A. Generally

A process for reducing gaseous sulfur dioxide in the combustion of pulverized coal is presented. Natural gas is injected substantially in parallel with the coal and combustion air stream into an upper region of the coal combustion zone, thereby increasing the temperature of the upper region. The temperature increase promotes increased conversion of sulfur dioxide to sulfur trioxide.

Since sulfur trioxide is more reactive with the particulate matter which is produced by coal combustion than sulfur dioxide, the amount of sulfur in the particulate matter is increased, and the amount of gaseous sulfur dioxide is reduced. Since sulfur increases the conductivity of the particulate matter, the ability to electrically precipitate the particulate matter is enhanced, resulting in increased particulate removal from the exhaust plume.

Figure 1:
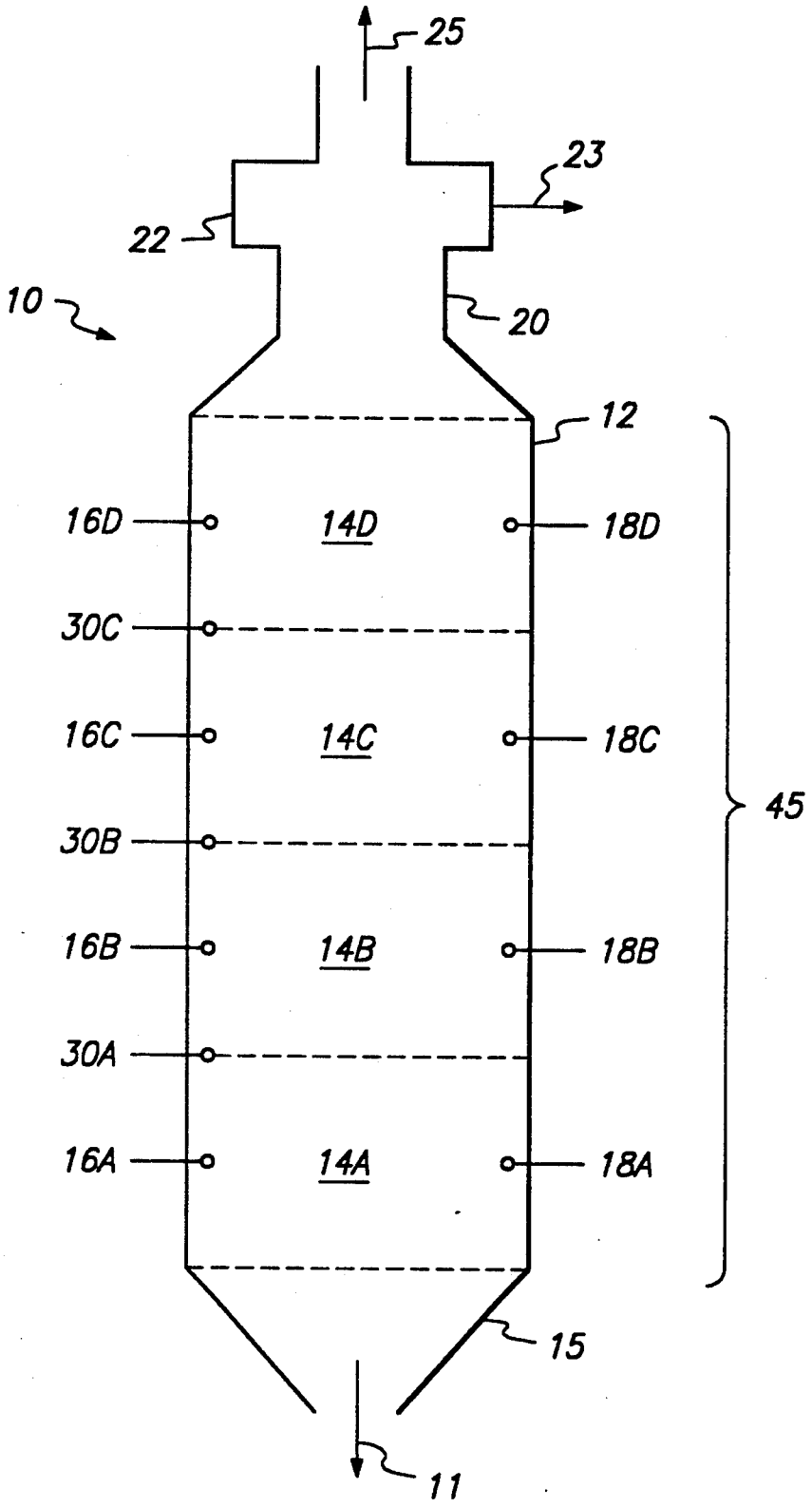
FIG. 1 is a block diagram illustrating a simplified combustion system.

Referring now to FIG. 1, a simplified block diagram of a typical combustion unit 10 for burning sulfur-bearing pulverized coal depicts a main combustion chamber 12 comprised of a plurality of burner levels 14A, 14B, 14C, and 14D. The combustion chamber 12 is prewarmed by firing a natural gas flame through warm-up gun 15. The combustion chamber 12 is fired on pulverized coal by injecting the coal and combustion air into the combustion chamber 12 at burners 16A, 16B, 16C, and 16D. Alternatively, the combustion chamber could be operated with other fuels, such as natural gas or oil, by firing the fuel through burners 30A, 30B, and 30C. The burners 30C, 30B and 30A are located below the burners 16D, 16C and 16B, respectively. All of the burners 30C, 30B and 30A are located below burner 16D. It should be recognized that the figure is illustrative only, and a typical configuration includes burner arrays on more than one wall, for example, a tangentially-fired boiler has burner arrays located in each of four corners and a wall-fired boiler in one of the possible configurations has burner arrays located on opposing walls It should also be recognized that the burners are completely conventional in design, that is, the burners mix fuel with excess air in order to achieve complete combustion of the fuel.

The initial combustion of coal is started by natural gas flames provided through ignitors 18A, 18B, 18C, and 18D. In a typical boiler, ignitors 18A, 18B, 18C, and 18D are located on the wall adjacent to burners 16A, 16B, 16C, 16D and 30A, 30B, 30C. A coal flame is thus developed in the entire combustion chamber 12, and is generally referred to as the combustion zone 45.

Figure 2A:
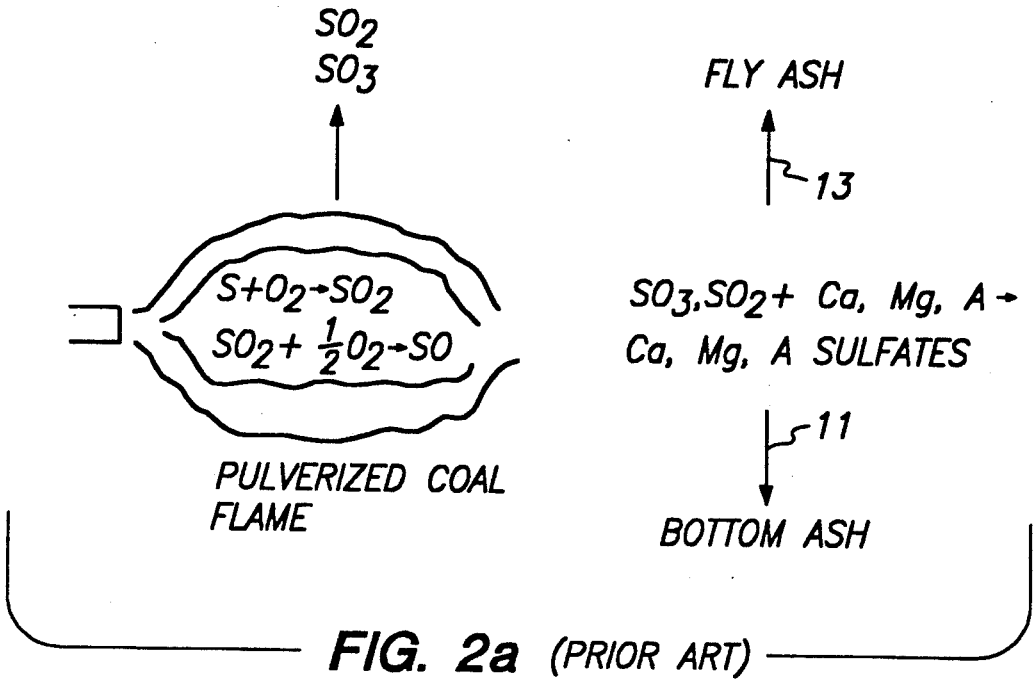
FIG. 2a (PRIOR ART)
FIG. 2*a* is a side plan view of a portion of the combustion system of FIG. 1 illustrating sulfur distribution for a conventional pulverized coal flame.

Referring now to FIG. 2*a*, the combustion of sulfur-bearing pulverized coal yields four sulfur-containing compounds: gaseous $SO_2$ (sulfur dioxide) and $SO_3$ (sulfur trioxide), fly ash particulates, and bottom ash particulates. Most of the sulfur in the coal oxidizes to form gaseous $SO_2$ in the exhaust stream. A small amount of the already-formed $SO_2$, oxidizes to form $SO_3$. The $SO_3$ has a higher affinity for the remaining mineral particulate matter (e.g., calcium, magnesium, alumina) resulting from combustion and thus readily forms sulfates which make up in part the fly ash and bottom ash. The bottom ash simply falls to the bottom of the combustion chamber 12, as indicated by arrow 11, where it may be collected and safely disposed of. The fly ash and gaseous sulfur compounds, however, rise into the exhaust duct 20 of the combustion unit 10, as indicated by arrow 13.

Figure 2B:
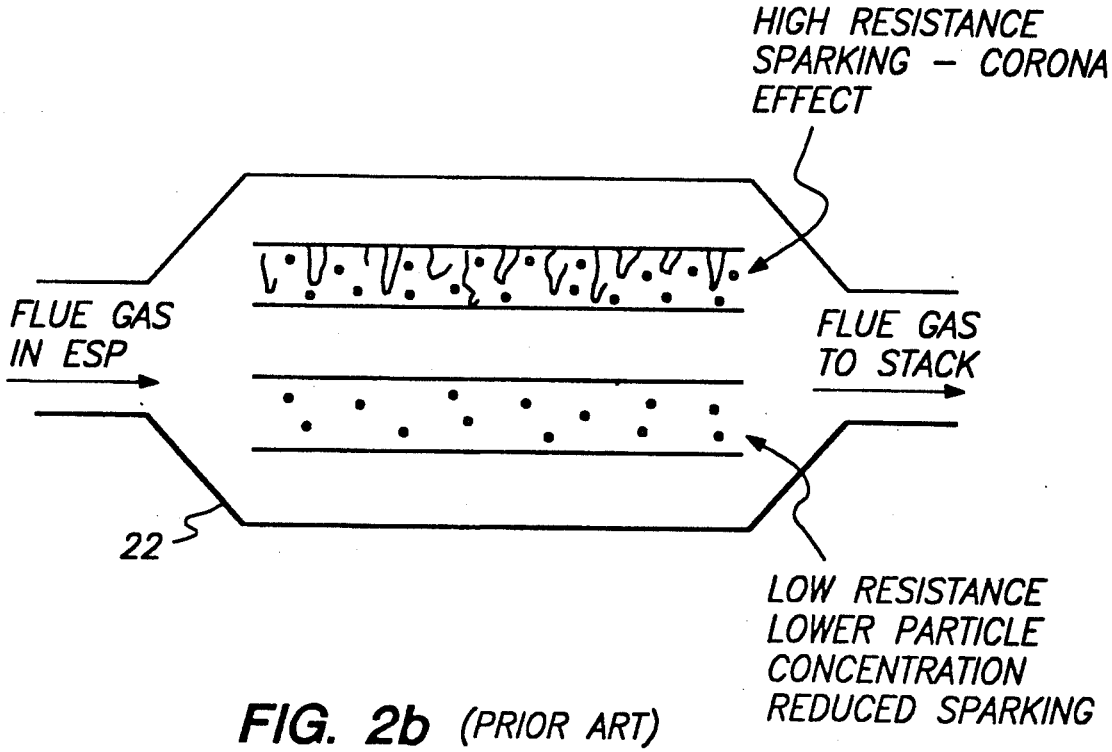
FIG. 2b (PRIOR ART)
FIG. 2*b* is a plan view illustrating the operation of a conventional electrostatic precipitator.

Referring back to FIG. 1, the fly ash and gaseous sulfur compounds are then processed through an electrostatic precipitator 22, where additional particulate matter is removed, as indicated by arrow 23, prior to venting the exhaust into the atmosphere, as indicated by arrow 25. The effectiveness of the electrostatic precipitator 22 increases as the conductivity of the exhaust stream increases. Where the conductivity of the exhaust stream is low (resistivity high), then the Corona Effect is observed and less precipitation occurs. See FIG. 2*b*.

According to the present invention, a second fuel, preferably natural gas, is injected into the upper region of the combustion zone 45 through either burner 30B or 30C. This second fuel must have a higher heating value than coal and negligible sulfur content to optimize the process. It is preferable that the injected fuel intimately mix with the coal flame, thereby causing no change in appearance of the combustion zone 45 relative to that for operation on 100% coal in terms of size and shape, which optimizes the effectiveness of the present invention. This is accomplished by firing the second fuel into the combustion zone 45 in substantially the same direction as the coal/air stream. The higher heating value of the second fuel causes this fuel to be consumed in a short residence time. Thus, the higher heating value of natural gas promotes quick heat release in a short residence time, which raises the temperature of the upper region of combustion zone 45 and delays the quenching of the flue gas temperature, thus promoting faster burnout of the coal particles in the upper region of combustion zone 45. In this manner, the flue gas from the lower regions of the coal combustion zone is processed through a higher temperature zone than would be possible with coal combustion alone.

Figure 3:
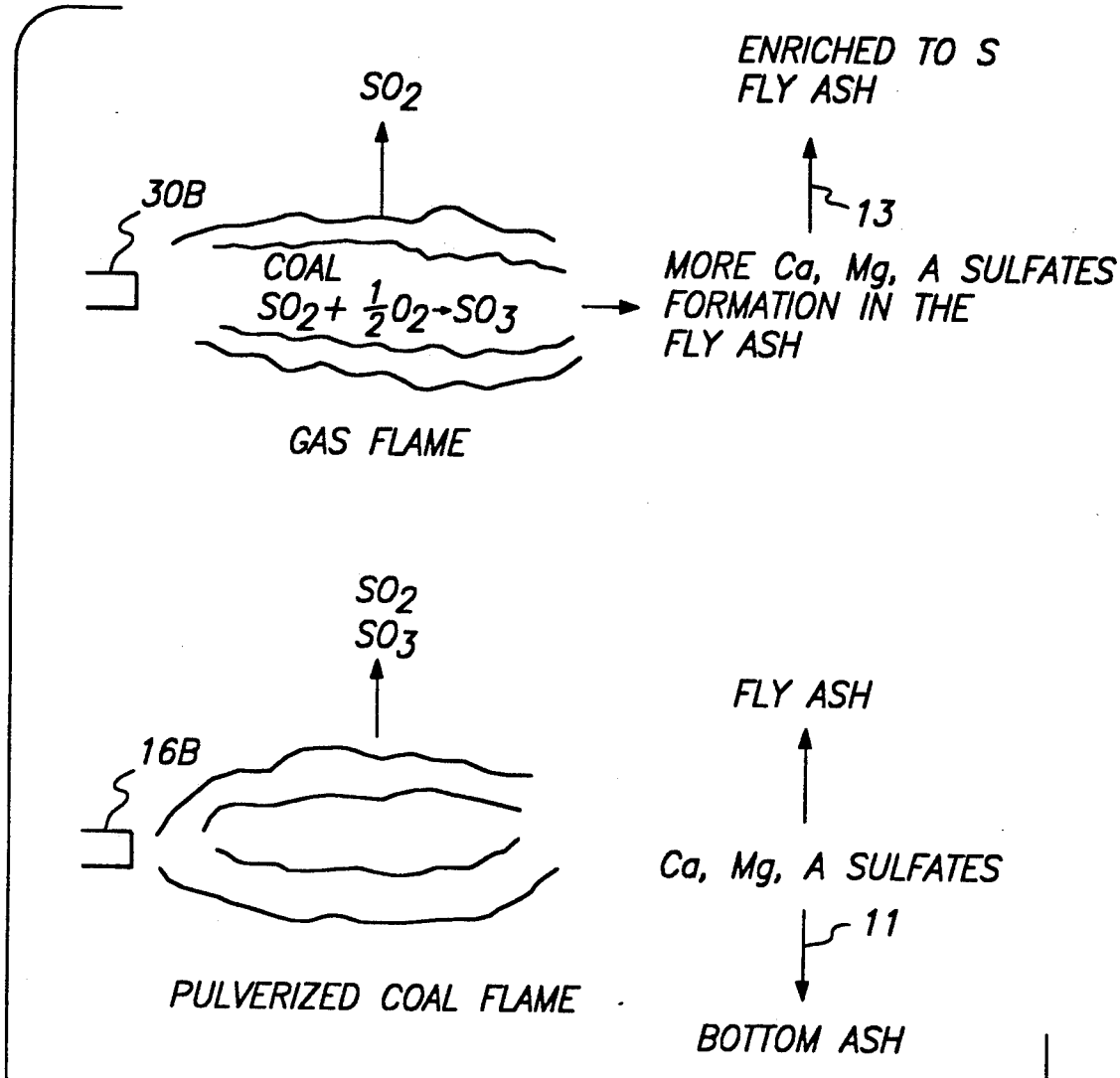
FIG. 3 is a side plan view of a portion of the combustion system of FIG. 1 illustrating sulfur distribution when a pulverized coal flame is cofired with natural gas according to the present invention.

As noted above, the sulfur contained in the coal oxidizes mostly to gaseous $SO_2$ during combustion. However, when the coal flame is processed through the higher temperature zone created by the cofiring of natural gas and coal in the upper region of the combustion zone, more of the already-formed $SO_2$ is oxidized to $SO_3$. The $SO_3$ thus formed in the flame reacts with the mineral matter (calcium, magnesium alumina) more readily than the $SO_2$ in the coal ash. Thus, oxidizing the $SO_2$ to $SO_3$ increases the sulfate content in the fly ash and reduces the $SO_2$ content in the flue gas. This is illustrated in FIG. 3. The increased sulfate content in the fly ash increases its electrical conductivity. This increased conductivity in turn improves the collection efficiency of the electrostatic precipitator, consequently reducing the flue gas particulate content. Thus, the opacity of the flue gas emitted into the atmosphere is reduced.

The maximum conversion of $SO_2$ to $SO_3$ occurs when the second fuel is injected into an upper region of the combustion chamber such that already-formed $SO_2$ is processed through the higher temperature flame. The only limitation for the injection site is that the exhaust gas temperature of the combustion unit 10 must be maintained within certain preset limits in order to avoid fly ash slagging and fouling on the heat exchanging surfaces, which is a function of the coal ash properties.

In order to demonstrate certain aspects and embodiments of the present invention, the following experimental samples are provided. It should be understood that the examples are merely illustrative and not limiting.

B. Experimental Results

Tests were conducted on a Combustion Engineering tangential-fired, multiple-fuel-capable boiler rated at 450 mW and delivering 3,200,000 pounds of steam per hour at 3614 psi and 1005° F. (four burner levels operating). The unit was also supplied with overfire air for $NO_x$ control, a cold precipitator for particulates, and a stack. The boiler was optimized for 100% coal operation. Relevant criteria for optimization included minimum slagging and fouling, maintenance of desired bulk steam temperature, no upward excursion in stack emissions, and minimum feasible heat rate. Optimum boiler performance at full load on 100% coal firing was achieved with 4.5% to 5.0% excess $O_2$, 65% overfire air, windbox/furnace pressure differential of 7.0 to 8.0 inches $H_2O$, coal burner levels B-C-D-E in service with no mill bias, level A out of service, and burner tilts on automatic.

Figure 4:
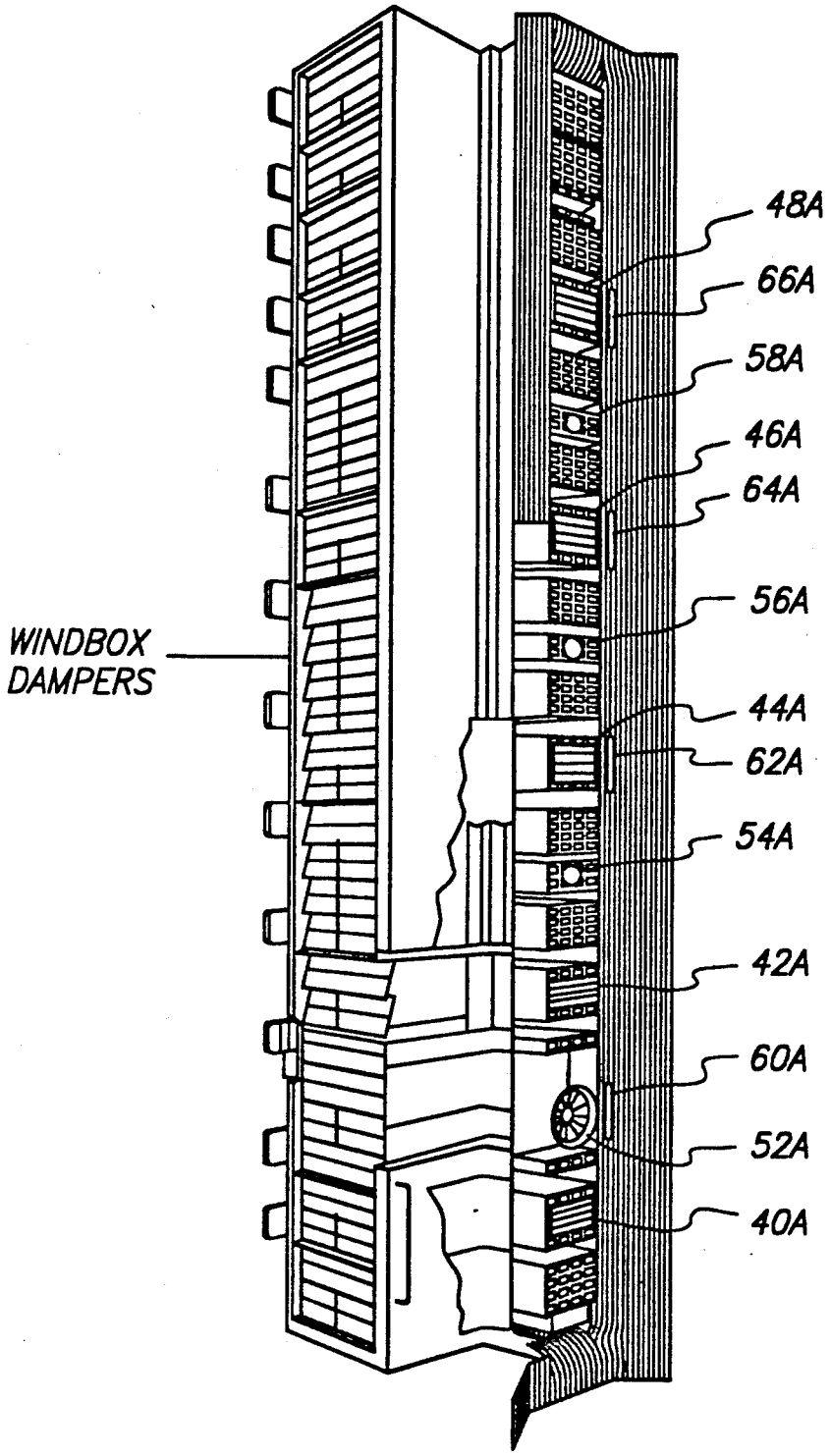
FIG. 4 is a perspective view of one of the four corners of a conventional tangential-fired boiler illustrating the burner arrangement.
Figure 5A:
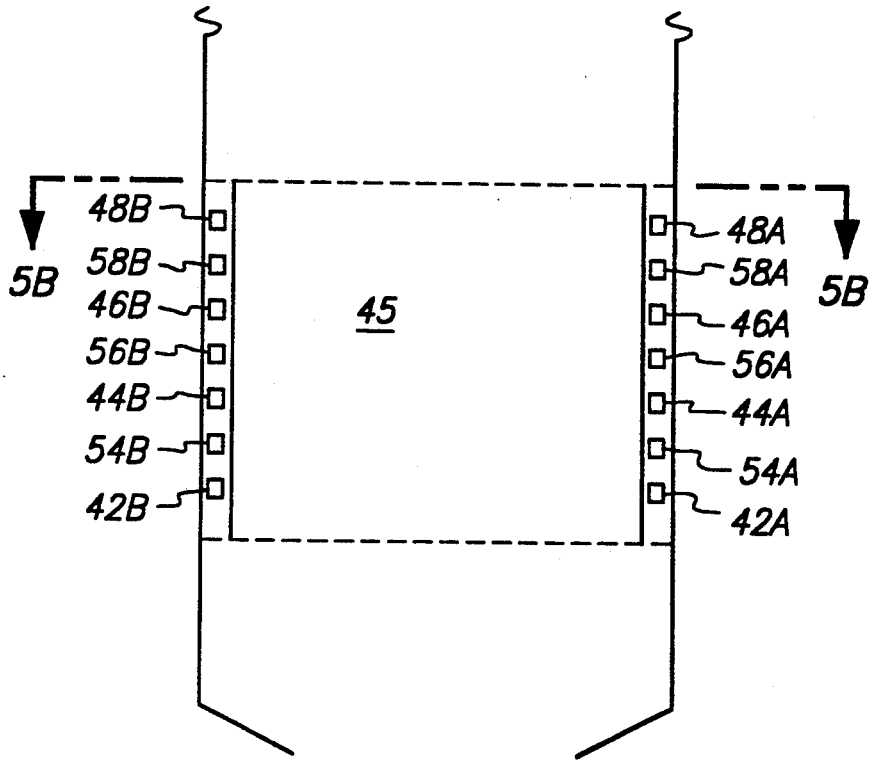
FIG. 5*a* is a side plan view of a tangentially-fired boiler configured according to the present invention.
Figure 5B:
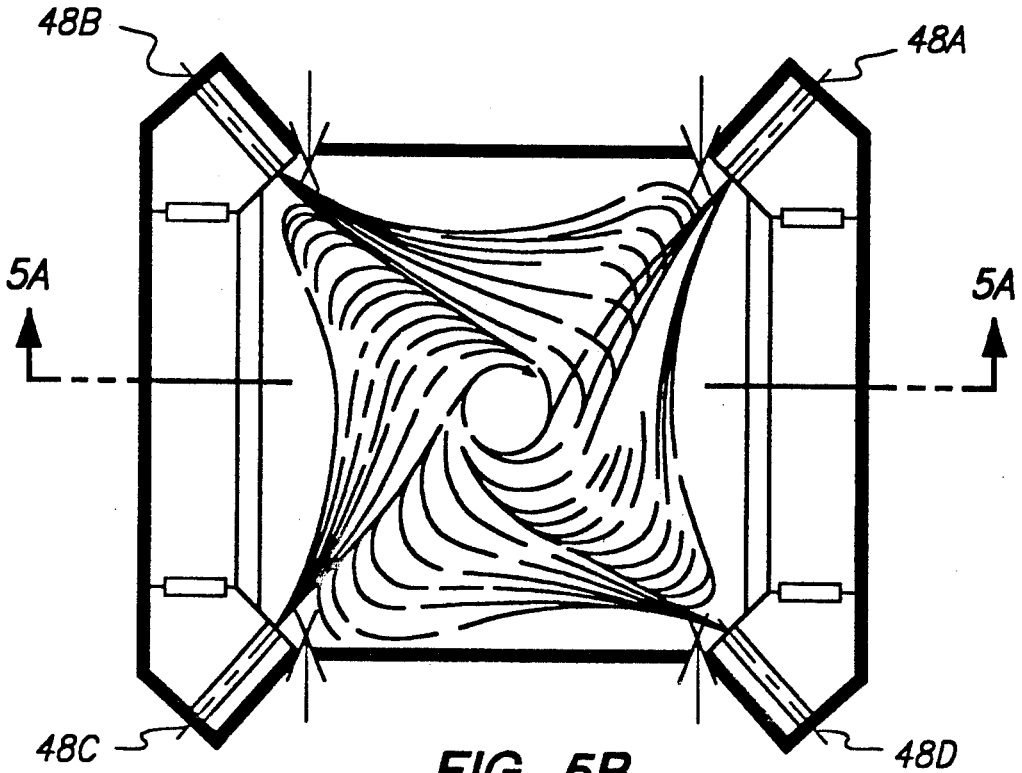
FIG. 5*b* is a top plan view of the boiler of FIG. 5*a* taken across section 5*b*–5*b*.

FIG. 4 illustrates one corner of a tangentially-fired multi-fuel capability boiler with five coal burners 40*a*, 42*a*, 44*a*, 46*a*, and 48*a*. A coal flame is started by firing natural gas through ignitors 60*a*, 62*a*, 64*a*, and 66*a*. It is of course recognized that the boiler has three additional corners configured identically to the one illustrated. Thus, a coal flame is developed in the combustion zone 45, as illustrated in FIGS. 5*a* and 5*b*. The boiler also has the capability of being fired on 100% gaseous fuel by delivery through gas burners 52*a*, 54*a*, 56*a*, and 58*a*. Burner 52*a* is located between burners 40*a* and 42*a*, gas burner 54*a* is located between burners 42*a* and 44*a*, gas burner 56*a* is located between burners 44*a* and 46*a*, and gas burner 58*a* is located between burners 46*a* and 48*a*.

Figure 6:
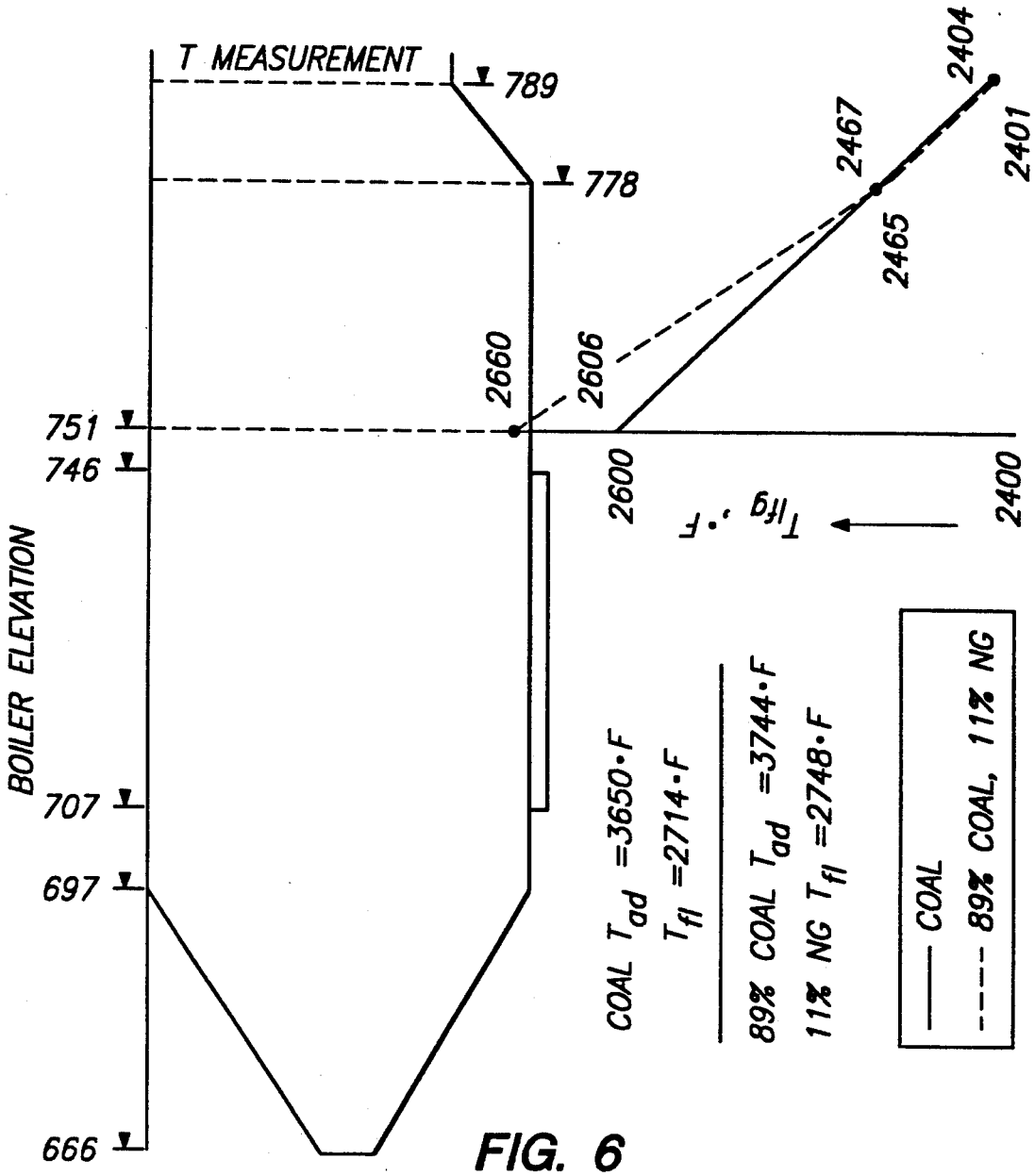
FIG. 6 is a graphical representation of the temperature of flue gas as a function of boiler elevation when pulverized coal is cofired with natural gas according to the present invention.

According to the present invention, 11% natural gas (based upon fuel Btu input) was cofired into the combustion chamber through gas burners 56 substantially in parallel with the coal and combustion air stream with the boiler operating at full-load. The resulting temperature profile of the flue gas as a function of boiler elevation is illustrated in FIG. 6.

Figure 7:
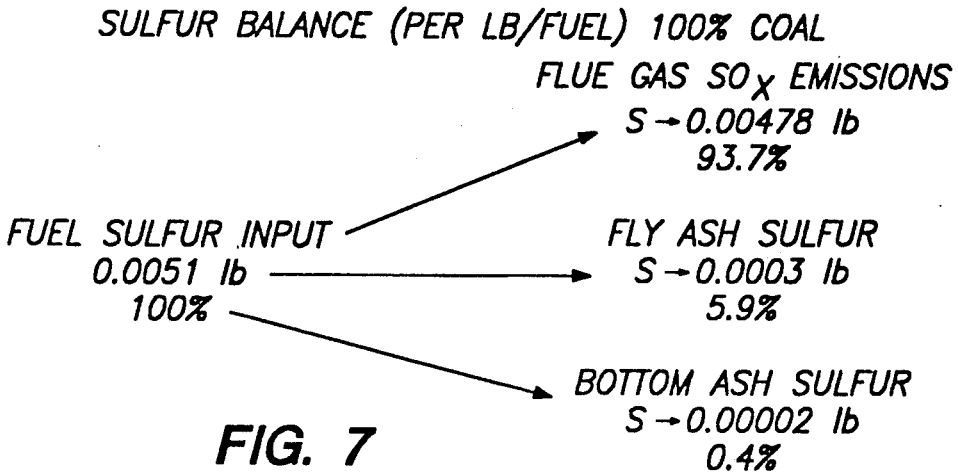
FIG. 7 illustrates a sulfur balance for a tangentially-fired boiler fired on 100% coal.
Figure 8:
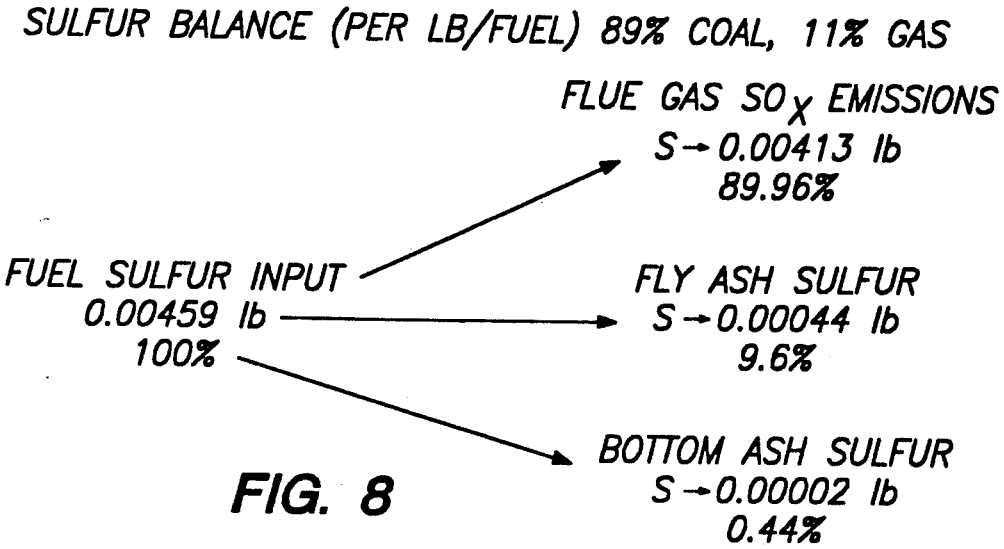
FIG. 8 illustrates a sulfur balance for a tangentially-fired boiler fired on 89% coal and 11% natural gas.

Samples of the fly ash, bottom ash, and input coal were taken for firings of 100% coal, and for firings of 89% coal and 11% natural gas. Sulfur balances were then performed, and the results are illustrated in FIGS. 7 and 8. The sulfur balances showed a significant increase in sulfur retention in the fly ash. In fact, as shown in Table I, the sulfate level in the fly ash increased nearly four times, and the sulfate level in the bottom ash nearly doubled as a result of the 11% gas cofiring.

TABLE I

| | 100% Coal | | 89% Coal, 11% Gas | |
|---|---|---|---|---|
| Sample | Sulfur | Sulfate | Sulfur | Sulfate |
| Coal | 0.51 | 0.01 | 0.51 | 0.01 |
| Fly Ash | 0.56 | 0.11 | 0.65 | 0.42 |
| Bottom Ash | 0.27 | 0.06 | 0.27 | 0.11 |

Samples of the flue gas were also taken, and the average $SO_2$ level for 100% coal firing was 1.05 lb/MBtu, whereas the average $SO_2$ level for 89% coal and 11% gas was 0.87 lb/MBtu, a 17.1% reduction in average $SO_2$ level. This compared well with sulfur balance results, which showed a 13.6% reduction in average $SO_2$ levels. Testing the flue gas for opacity showed average levels of 9.2% opacity for 100% coal firing, and 5.9% opacity for 89% coal and 11% gas firing, a 35.9% reduction in average opacity of the flue gas.

Figure 9A:
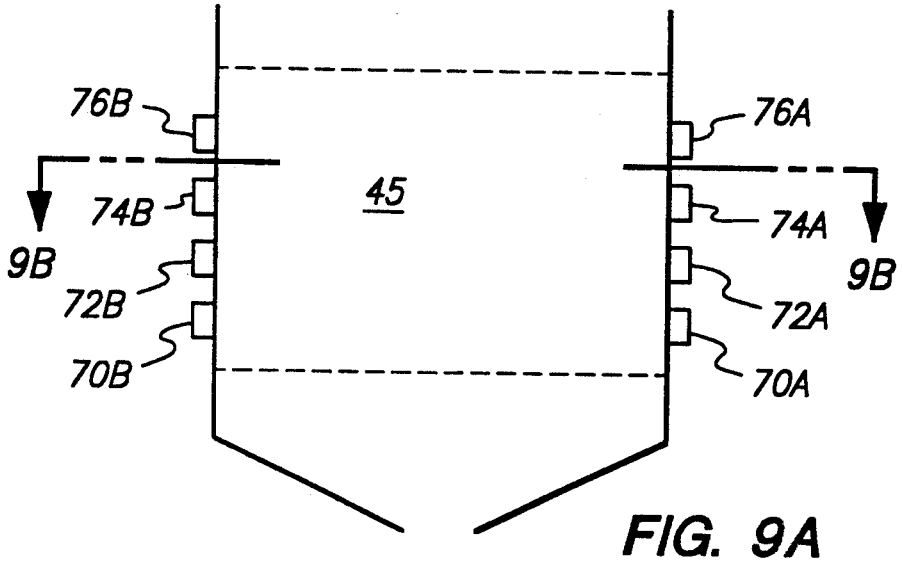
FIG. 9*a* illsutrates a side plan view of a wall-fired boiler configured according to the present invention.
Figure 9B:
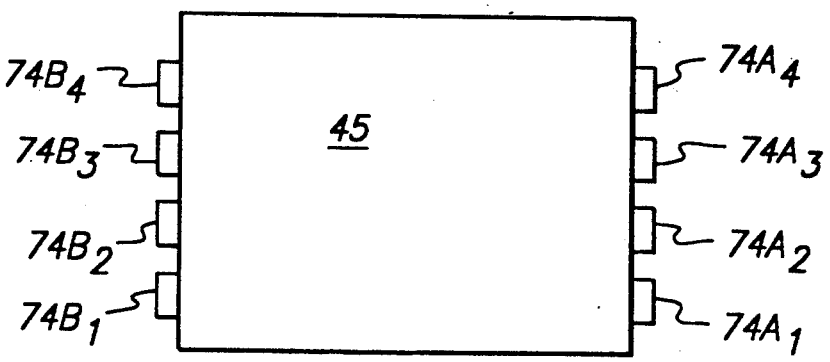
FIG. 9*b* illustrates a top plan view of the boiler of FIG. 9*a* taken across section 9*b*–9*b*.

It should be recognized by those skilled in the art that there are additional embodiments which would be within the scope of the present invention. For example, a wall-fired boiler is illustrated in FIGS. 9*a* and 9*b*. Coal is fired through an array of coal burners mounted on either one wall or on opposing walls of the boiler. Thus, FIG. 9*a* illustrates coal burner rows 70*a*, 70*b*, 72*a*, 72*b*, 74*a*, and 74*b*. Natural gas is cofired into the upper region of the boiler through gas burner rows 76*a* and 76*b*. FIG. 9*b* illustrates the coal burners 74*a*$_1$, 74*a*$_2$, 74*a*$_3$, 74*a*$_4$, 74*b*$_1$, 74*b*$_2$, 74*b*$_3$, and 74*b*$_4$ in burner rows 74*a* and 74*b*. The scope of the invention is defined by the accompanying claims.

We claim:

1. A process utilizable in the combustion of pulverized sulfur-containing coal for reducing the emission of gaseous sulfur dioxide and for increasing the removal of particulate matter, wherein pulverized sulfur-containing coal and combustion air are injected through a plurality of vertically disposed burners into a combustion chamber and fired to create a combustion zone within the chamber, thereby creating emission products, including particulate matter and gaseous sulfur compounds, such as sulfur dioxide, the emission products being directed to an exhaust means where the particulate matter is removed, comprising:

a. injecting a fuel and combustion air through at least one fuel burner into the combustion chamber at at least one location below at least one of said plurality of coal burners, said fuel and combustion air being injected substantially parallel to the injection of the coal and its combustion air stream, said fuel containing negligible sulfur and having a heating value higher than coal.

2. A process, according to claim 1, wherein the fuel is a gaseous fuel.

3. A process according to claim 2, wherein said gaseous fuel is natural gas.

4. A process for reducing the amount of sulfur dioxide and particulate matter emitted in the combustion of coal, wherein a combustion unit includes a plurality of burners disposed vertically thereon for injecting fuel and combustion air into the combustion unit, and wherein coal and combustion air are injected into a first predetermined number of the burners to thereby develop a coal flame in the combustion unit, the process comprising injecting natural gas and combustion air through at least one burner other than the predetermined number of burners at a location below at least one of the predetermined number of coal burners and substantially parallel to the injection of the coal.

5. A method for reducing sulfur oxides and particulates in coal combustion exhaust gases, wherein a combustion unit has an inlet, upstream end and an outlet, downstream end, comprising:

injecting coal and combustion air into the combustion unit through a plurality of coal burners; and injecting natural gas and combustion air into the combustion unit through at least one gas burner, said gas burner being located upstream from at least one of the plurality coal burners.

* * * * *

UNITED STATES PATENT AND TRADEMARK OFFICE

CERTIFICATE OF CORRECTION

PATENT NO. : 5,311,829

DATED : May 17, 1994

INVENTOR(S) : Kimble J. Clark, Tsvetan S.I. Torbov, Thomas D. Burnett & Robert J. Impey It is certified that error appears in the above - identified patent and that said Letters Patent is hereby corrected as shown below:

Front page, column 1, lines 4 thru 7, should read as follows:

"[75] Inventors: Kimble J. Clark, Los Altos, Ca; Tsvetan Steven Ivanov Torbov San Jose, Ca; Thomas D. Burnett, Houston, Tex; Robert J. Impey, San Jose, Ca."

Front page, column 2, in the Abstract, line 13, delete the duplicate of "of the"

Column 6, line 60, insert "of" after "plurality"

Signed and Sealed this

Seventeenth Day of January, 1995

*Attest:*

*Attesting Officer*

Bruce Lehman

BRUCE LEHMAN

*Commissioner of Patents and Trademarks*

UNITED STATES PATENT AND TRADEMARK OFFICE

CERTIFICATE OF CORRECTION

PATENT NO. : 5,311,829

DATED : May 17,1994

INVENTOR(S) : Kimble J. Clark, Tsvetan S. I. Torbov, Thomas D. Burnett & Robert J. Impey It is certified that error appears in the above-indentified patent and that said Letters Patent is hereby corrected as shown below:

On the title page, item [73] the first Assignee should read--Aptech Engineering Services, Inc.--.

Signed and Sealed this

Eighteenth Day of April, 1995

Bruce Lehman

*Attest:*

BRUCE LEHMAN

*Commissioner of Patents and Trademarks*

*Attesting Officer*